United States Patent [19]

Crosby

[11] 4,396,225

[45] Aug. 2, 1983

[54] RECLINER

[75] Inventor: Lawton H. Crosby, Lake Bluff, Ill.

[73] Assignee: Morley Furniture Spring Corporation, Lake Bluff, Ill.

[21] Appl. No.: 228,464

[22] Filed: Jan. 26, 1981

[51] Int. Cl.[3] ..... A47C 1/02

[52] U.S. Cl. ..... 297/75; 297/452

[58] Field of Search ..... 297/452, 455, 75, 456

[56] References Cited

U.S. PATENT DOCUMENTS

| | | | |
|---|---|---|---|
| 3,071,413 | 1/1963 | Flint et al. | 297/456 |
| 3,081,076 | 3/1963 | Strout et al. | 297/456 X |
| 3,244,449 | 4/1966 | Re' | 297/75 |
| 3,493,264 | 2/1970 | Re' | 297/75 |
| 3,998,371 | 12/1976 | Tieman | 297/452 |
| 4,231,615 | 11/1980 | Griffiths | 297/452 |
| 4,303,232 | 12/1981 | Crosby | 297/452 |

FOREIGN PATENT DOCUMENTS

| | | | |
|---|---|---|---|
| 2647168 | 4/1978 | Fed. Rep. of Germany | 297/452 |

*Primary Examiner*—Francis K. Zugel

*Attorney, Agent, or Firm*—Hume, Clement, Brinks, Willian & Olds, Ltd.

[57] ABSTRACT

A cushion base and ottoman assembly in a recliner. The assembly has a front rail normally with a relatively wide upper surface. A vertically resilient jaw unit is mounted on the upper surface of the front rail, the jaw unit having a fish mouth configuration opening forwardly. Upholstery material is drawn over the cushion base assembly whereby a recess is formed below the jaw unit and in front of the front rail. The ottoman nests in this recess when retracted. When extended the assembly continues to resiliently support a cushion out to its front edge.

5 Claims, 8 Drawing Figures

FIG. 1
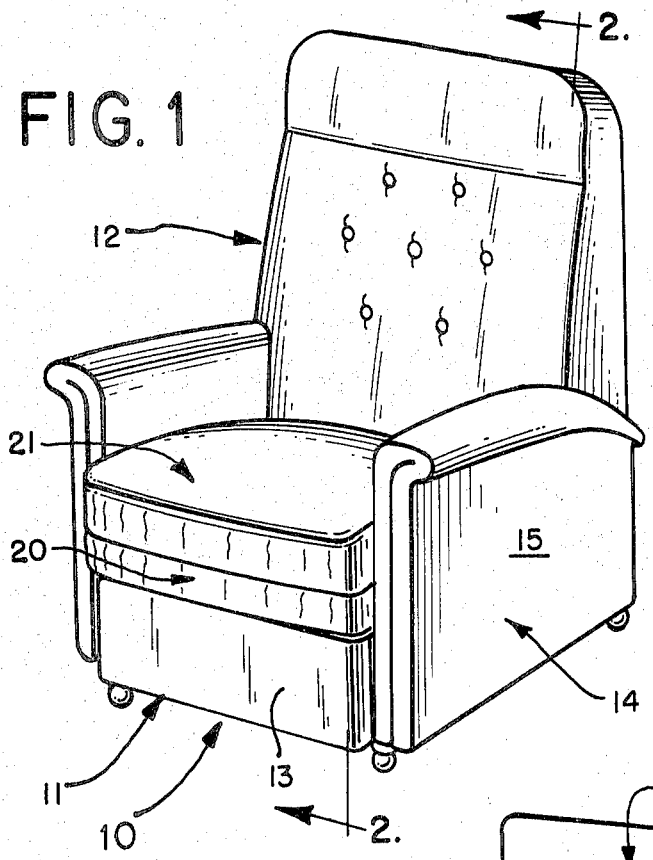
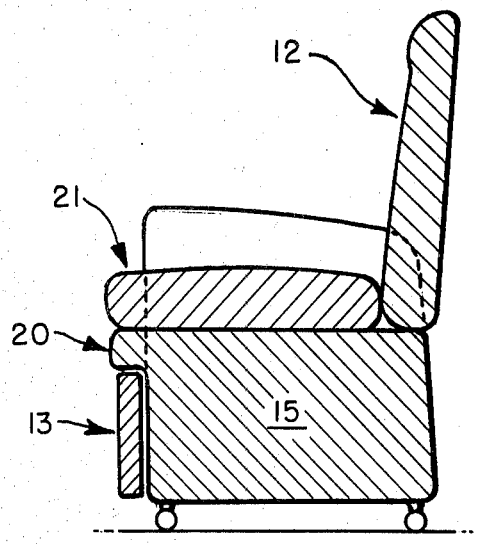
FIG. 2
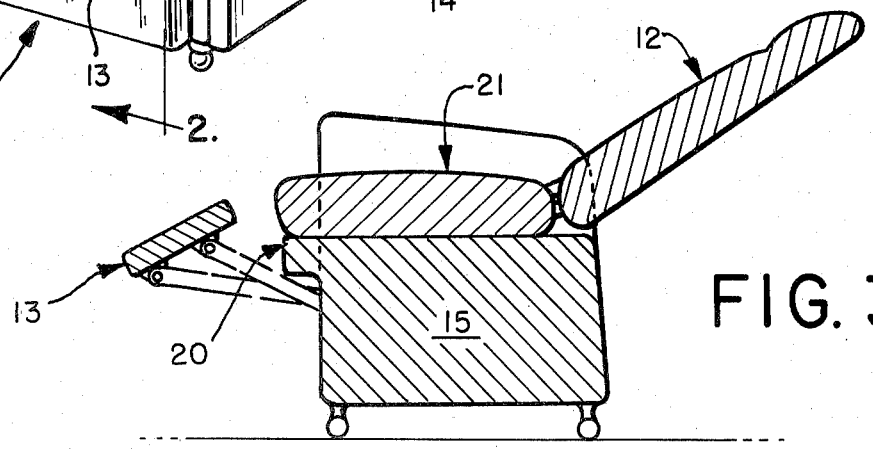
FIG. 3
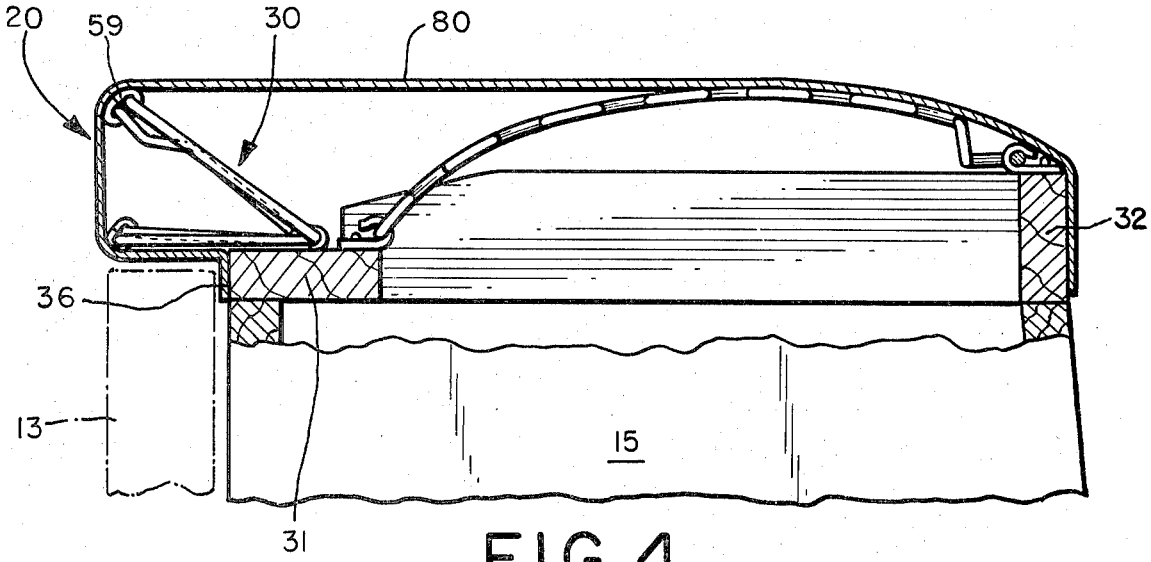
FIG. 4

RECLINER

FIELD OF THE INVENTION

This invention relates generally to upholstered furniture. It relates particularly to an improved construction for chairs of the types known in the industry as recliners, handle-rockers, and rocker-recliners.

BACKGROUND OF THE INVENTION

Recliners comprise a small but very profitable segment of the upholstered furniture market. These reclining back chairs, with their extendable ottomans, are manufactured by several large U.S. firms in a variety of styles and price ranges. From a mechanical standpoint the chairs employ interconnected frame and lever elements which, when the seat back is inclined rearwardly, cause the ottoman to move from a retracted position into an extended position on which a seated subject's feet can rest.

Recliners have historically been manufactured in a tight seat construction or, in some cases, a simulated loose cushion construction. In either case the cushion base assembly has employed a "hard-edge" at the front rail of the base frame; hard edge meaning, in the furniture industry, that no spring induced resilience is effective at the front rail.

Only in recent years have manufacturers, seeking to achieve finer quality and higher style in recliners, began to use a fully loose cushion construction, but still with "hard-edge". It is a more expensive construction but commands a substantially higher price. The nature of hard edge construction has made it virtually impossible to eliminate cushion gap between the cushion and the front rail in recliners, however. Inadequate support for the cushion at the front rail when the ottoman is extended has also been an inherent shortcoming of loose cushion recliners.

Most loose cushion recliners now on the market are designed so that the ottoman retracts into a position immediately in front of the front rail of the seat frame. The cushion, supported by the cushion base assembly, extends forwardly of the frame, above the ottoman, for a distance equal to the thickness of the ottoman. When the ottoman is retracted it nestles neatly and unobtrusively under the front end of the cushion and against the front frame rail. In this position it supports the cushion. When the ottoman is extended, the forwardmost 1½" to 3" portion of the cushion has no support. The result is unsatisfactory from both functional, sales/marketing, and aesthetic standpoints. The industry has long but unsuccessfully sought to remedy this defect.

The industry recognizes that a spring-edge would greatly increase comfort under the knees when the footrest is extended. This would justify a higher price. The difficulties inherent in the cushion overhang noted above, and, therefore, the required protrusion of any spring-edge below such overhang, have been considered insuperable and to date have baffled and thwarted the industry in its desire for a recliner spring-edge. Thus far, therefore, all loose cushion recliner styles have been without exception clipped to, snapped onto, or otherwise connected with the main span or body of the sinuous springs or other cushion base. This drastically limited their breadth of applicability, grossly circumscribed their capability to handle cushion overhang, and completely prevented their providing the necessity of a protruding lower upholstery wrapping-edge (or line) matching the equally protruding spring-edge required to be plumb with the cushion overhang.

To capsulize the situation, there were two problems considered insolvable. First, how to base a spring-edge able to support a cushion overhang as much as three inches (3") forward of the front edge of the front rail. Second, how to get a workable lower upholstery line (or wrapping-edge) vertically below the upper spring-edge, and therefore also as much as three inches (3") forward of the front edge of the front rail. Until this invention, there were no answers. Now, for the first time in furniture, this invention embodies a spring-edge that is front-rail based, rather than main span spring based. Neither of the members of this new spring-edge concept, upper or lower, depend on or have any connection with, the springs or other cushion support members. This at once emancipates it from all prior strictures, not only as to coping successfully with overhang, but also for the first time able to ensure closure of cushion gap independent of a main span spring point-of-beginning, and, most importantly, provides for the first time fully for a lower upholstery wrapping-edge forward of the front edge of the front rail, and plumb with a similarly extended spring-edge and cushion overhang.

SUMMARY OF THE INVENTION

An object of the present invention is to provide an improved recliner construction. Another object is to provide an improved loose cushion recliner construction. Yet another object is to provide an improved loose cushion recliner construction wherein cushion support is provided out to the front edge of the cushion in all operating modes of the recliner. Still another object is to provide an improved loose cushion recliner construction wherein a spring front edge is achieved.

The foregoing and other objects are realized in a recliner by providing a new cushion base and ottoman assembly. The cushion base has front and back frame rails connected by a pair of side rails. The front frame rail is disposed horizontally (or vertically) while the back frame rail is conventionally vertical. In the preferred form resilient cushion support is provided by a plurality of sinuous spring bands stretched between the back rail and the front rail.

According to the invention a vertically resilient "jaw" unit is mounted immediately adjacent the connections between the sinuous spring bands and the front rail, on the upper surface of the front rail. The jaw unit includes a plurality of jaw members having what will be characterized as a fish mouth configuration spaced at intervals along the upper surface of the front rail.

The base of each jaw member extends parallel to the length of the front rail and is fastened to the upper surface of the rail. A lower jaw element extends transversely of the rail, forward of it to where it is fastened to a lower border wire extending across the width of the cushion base. An upper jaw element is inclined upwardly at an angle to the lower jaw element and also extends forward of the rail, terminating vertically above the lower border wire where it is fastened to an upper border wire also extending across the width of the cushion base.

Opposite end segments of the upper and lower border wires are bent parallel to the side rails and converge to where they come together at the surface of the rail. The free ends of these segments are, in turn, bent parallel to the front rail and clamped together. In addition, they are clamped to the corresponding base of each of the outermost jaw members.

The resulting interrelationship of fish mouth shaped jaw members and the two border wires forms a jaw unit which resiliently resists downward pressure on the upper border wire. The entire cushion base assembly is, in the process of manufacture, covered with upholstery material. Assembled into a recliner a cushion then rests on top of the sinuous spring bands with its front edge resting on the top of the jaw unit. As a result, the cushion sits flat on the cushion base assembly and no cushion gap results.

In a recliner, when the ottoman is unextended it sits immediately against the front rail of the cushion base assembly, underneath the jaw unit. The thickness of the ottoman is equal to the distance which the jaw unit protrudes forward of the front rail. When the ottoman is extended, as the recliner is operated, the space below the jaw unit is vacated. The cushion base assembly resiliently supports the cushion regardless of whether the ottoman is extended or retracted, however.

BRIEF DESCRIPTION OF THE DRAWINGS

The invention, including its construction and method of operation, as well as other objects and advantages thereof, is illustrated more or less diagramatically in the drawings, in which:

FIG. 1 is a perspective view of an improved recliner embodying features of the present invention;

FIG. 2 is a diagramatic side-elevational view of the improved recliner illustrated in FIG. 1;

FIG. 3 is a diagramatic, side-elevational view of the recliner illustrated in FIG. 1, in its reclining or extended position;

FIG. 4 is an enlarged side-elevational view of a portion of the recliner illustrated in FIGS. 1–3, with parts broken away;

DESCRIPTION OF THE PREFERRED EMBODIMENTS

Figure 5:
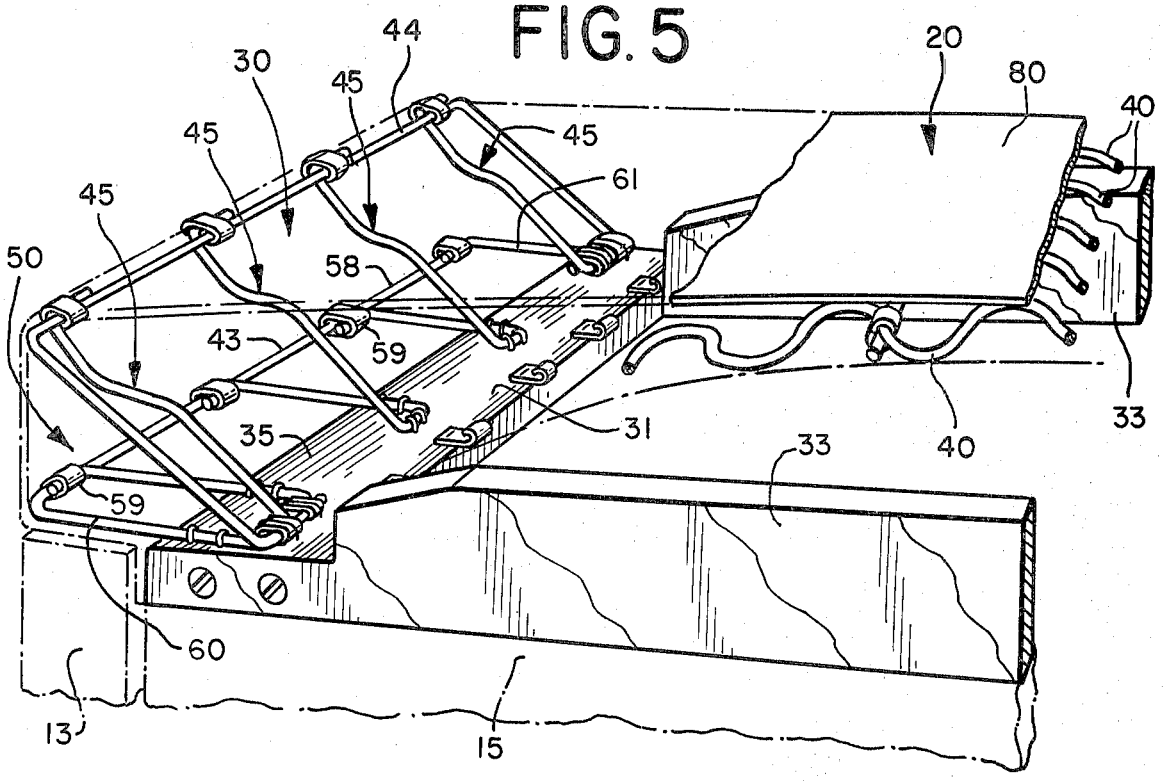
FIG. 5 is an enlarged perspective view of the recliner portion illustrated in FIG. 4, with parts removed.

Referring now to the drawings, and particularly to FIG. 1, an upholstered recliner chair is illustrated generally at 10. The recliner chair 10 includes an upholstered base or seat 11, a reclinable back 12, an extendable ottoman 13, and fixed sides 14.

The chair back 12 is movably connected to the base or seat 11 so that it can recline rearwardly in a conventional manner when actuated. As the back 12 reclines a lever mechanism (not shown) in the pedestal 15 of the base or seat 11 causes the ottoman 13 to swing upwardly and forwardly in a conventional manner from its illustrated, retracted position. The seated subject is then able to rest luxuriously in a reclining position, with feet supported in front of the seat or base 11 on the ottoman 13.

FIGS. 2 and 3 diagramatically illustrate the operation of the recliner 10. FIG. 2 shows the seat back 12 in its upright position and the ottoman 13 in its retracted position. FIG. 3 shows the seat back 12 in its reclining position and the ottoman 13 in its extended, foot-supporting position.

It will be seen in FIG. 2 that the ottoman 13, when retracted, nests underneath the forwardmost portion of the cushion base assembly 20 and, correspondingly, underneath the forwardmost portion of the cushion 21, itself. In this position it lies flush against the front of the pedestal 15.

In FIG. 3 the extended ottoman 13 has left its nest, so to speak. Nevertheless, the cushion base assembly 20 supports the cushion 21 completely out to its front edge.

Figure 6:
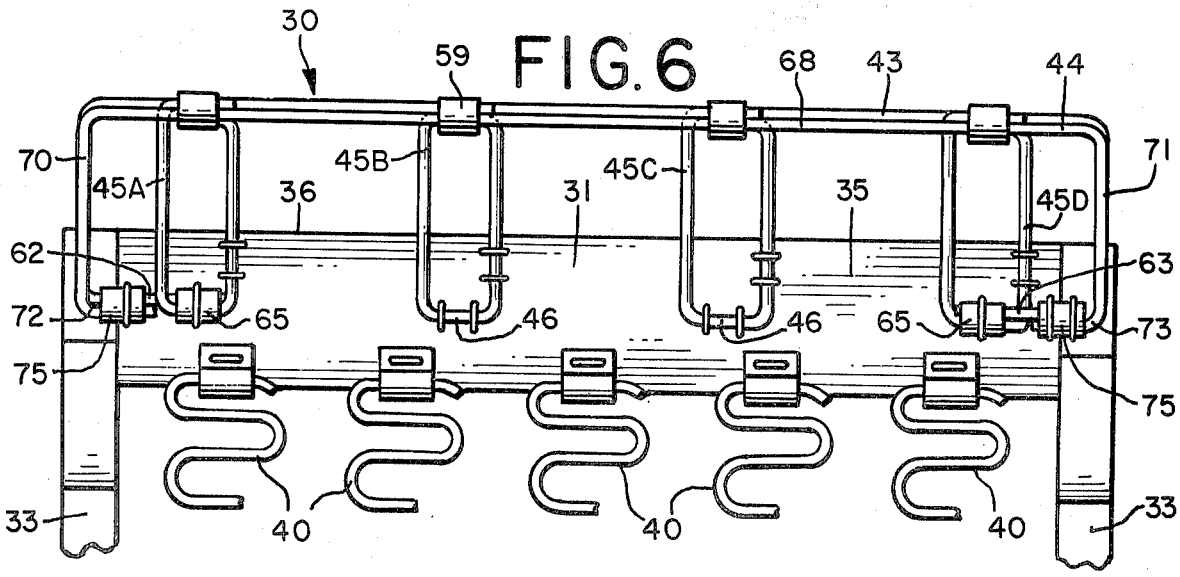
FIG. 6 is a top plan view of the recliner portion illustrated in FIG. 5, with parts removed.

Referring now to FIGS. 4–6, the seat or base 11 is shown with parts removed. Here the horizontal cushion base assembly 20 is seen to include a jaw unit 30. The jaw unit 30 supports the loose cushion 21 without cushion gap beneath the cushions front edge, regardless of whether the ottoman 13 is retracted or extended.

The cushion base assembly 20 includes a wood frame having a horizontally disposed front rail 31, a vertically disposed back rail 32, and vertically disposed side rails 33. The horizontally disposed front rail 31 has a relatively wide upper surface 35 on which the jaw unit 30 is mounted in such a manner that it extends forwardly of the front edge 36 of the front rail 31 for a distance of two inches (2").

Conventionally mounted between the back rail 32 and the front rail 31 of the cushion base assembly 20 are a series of sinuous spring bands 40. Each of the sinuous spring bands 40, five in the present illustration, is pivotally connected to the top of the back rail 32 and to the inner edge of the front rail 31.

The jaw unit 30, mounted on the upper surface 35 of the front rail 31 in a manner hereinafter discussed, includes four jaw members 45 spaced along the upper surface 35. The jaw members 45 form the vertabrae of the unit 30. They are interconnected by border members 43 and 44, the border members and the jaw members 45 both being fabricated of eight gauge wire, either paper covered or plastic-coated to minimize noise. The jaw members 45 and border members 43, 44 are clamped together to form a jaw unit 30 with jaws defining an open "fish mouth" 50 facing forwardly of the cushion base assembly 20.

Figure 7:
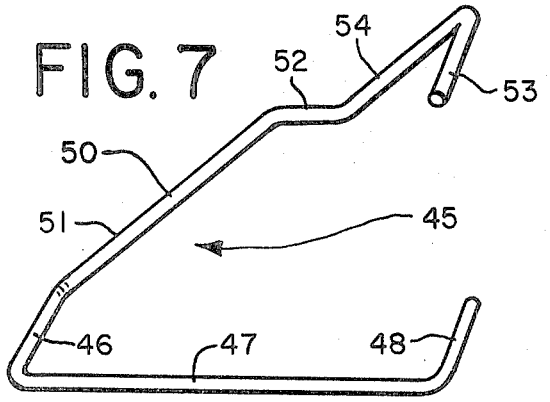
FIG. 7 is a perspective view of the jaw member component of the recliner.

The details of construction of the jaw unit 30 and the manner in which it is assembled in the cushion base assembly 20 are best understood by first describing the principle component of the jaw unit 30, the jaw member 45. In this regard, attention is invited to FIG. 7 where a jaw member 45 is illustrated in perspective.

The jaw member 45 includes a base 46. Extending perpendicularly from one end of the base 46 is a lower jaw element 47. The free end of the lower jaw element 47 has an attachment foot 48 extending therefrom, transversely of the lower jaw element 47 and parallel to the base 46.

Extending perpendicularly from the other end of the base 46 is an upper jaw element 50. The upper jaw element 50 includes an inner segment 51 which is inclined upwardly relative to the lower jaw element 47 at an angle of 37½°, and an outer segment 54 which is inclined upwardly at an angle of 30°. The free end of the outer segment 52 has an attachment foot 53 extending therefrom, transversely of the upper jaw element 50 and parallel, once again, to the base 46.

In the illustrated embodiment of the invention the base 46 is one and one-half inches (1½") in length, the lower jaw element 47 is three and one-half inches (3½") in length and the upper jaw element 50 is (effectively)

four inches (4") in length. Each of the attachment feet 48 and 53 is one and one-half inches (1½") in length.

In the illustrated embodiment of the invention four jaw members 45 are arranged parallel to each other with corresponding bases 46, attachment feet 48, and attachment feet 53, in longitudinal alignment with each other. Referring again to FIG. 6, the two center jaw members 45B and 45C are spaced four and three-quarter inches (4¾") apart while the two end jaw members 45A and 45D are each spaced three and one-half inches (3½") from a corresponding center jaw member 45B or 45C.

Referring again to FIGS. 4–6, the lower border wire 43 has a straight, center segment 58 which is fastened by identical sleeve clamps 59 to each of the attachment feet 48 on the four jaw members 45. Opposite side elements 60 and 61 of the lower border wire 43 are bent parallel to the lower jaw elements 47 of the jaw members 45. At the point where they come into alignment with the bases 46 of the jaw members 45 they are bent to form end segments 62 and 63 which come into alignment with the bases. These end segments 62 and 63 are clamped to the bases 46 of the outermost two jaw members 45A and 45D by sleeve clamps 65.

The upper border wire 44 has a straight, center segment 68 which is fastened by sleeve clamps 69 to each of the attachment feet 53 in the four jaw members 45. Opposite side segments 70 and 71 of the upper border wire 44 are bent parallel to the upper jaw elements 52 of the jaw members 45. At the point where they come into alignment with the bases 46 of the jaw members 45 they are bent to form end segments 72 and 73 which come into alignment with the bases. These end segments 72 and 73 are clamped to corresponding end segments 62 and 63 of the lower border wire 43 by sleeve clamps 75.

A jaw unit 30 has now been described in its assembled form. It is assembled in this manner prior to being mounted on the front rail 31. The jaw unit 30 is mounted on the upper surface 35 of the front rail 31 in such a manner that it extends for a distance of two inches (2") forwardly of the front edge of rail, as has been pointed out. This is accomplished by placing the bases 46 of the jaw members 45 flush against the upper surface 35 of the rail 31 at a point one and one-half inches (1½") from the front edge 36 of the rail and stapling them to the rail in this position. The lower jaw elements 47 of the jaw members 45 are also flush against the upper surface 35 of the rail 31 and are also stapled to the rail. Mounted in this position on the rail, the jaw unit 30 has its opposite side segments 60, 61 and 70, 71 of the border wires 43 and 44 extending parallel to and substantially flush with the outer surfaces of the side rails 33 in the wood frame of the cushion base assembly 20.

Having been assembled in this manner, the cushion base assembly 20 is covered with upholstery material by conventional techniques. As seen in FIG. 4 the material 80 is stretched over the top of the sinuous spring bands 40 and the jaw unit 30 and drawn tight against the bottom of the jaw unit to where it is secured to the front rail 31.

With the recliner 10 in use, the ottoman 13 is either extended as seen in FIG. 3 or nested in its retracted position as seen in FIG. 2. In the illustrated embodiment of the invention the ottoman 13 is two inches (2") thick, corresponding to the amount of overhang of the upholstered jaw unit 30 in the cushion base assembly 20. Accordingly, the front of the cushion 21, the front of the cushion base assembly 20 and the top of the ottoman 13 are flush with each other in vertical alignment at the front of the recliner. When the ottoman 13 is in its extended position the front of the cushion 21 and the upholstered jaw portion of the cushion base assembly 20 remain flush with each other, the latter supporting the former out to its front edge.

The jaw member 45 configuration which has been described, specifically with reference to the upper jaw element 52 bent into two segments 50 and 51, is for use with a wrapped cushion 21. Where non-wrappped cushions are employed, however, the upper jaw element 52 shape is preferably modified.

Figure 8:
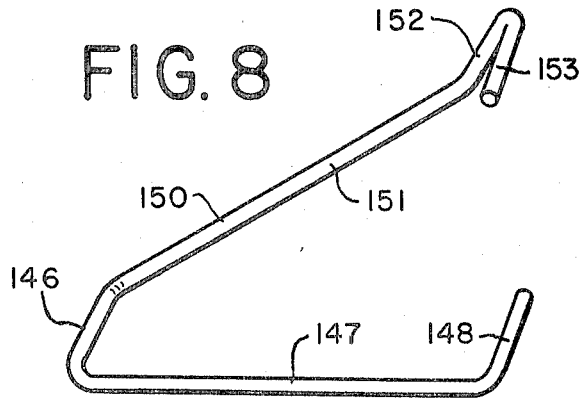
FIG. 8 is a perspective view of a modified form of jaw member component.

Turning to FIG. 8 a modified form of the jaw member 45 which is utilized in non-wrapped cushion recliner applications is illustrated generally at 145. The jaw unit 145 is identical to the jaw unit 45 hereinbefore discussed with one exception. Its upper jaw element 150 has only one bend in it so that inner and outer segments 151 and 152 are formed. The inner segment 151 is at 30° to the lower jaw element 147 and the outer segment 149 is at 60° to it.

Wrapped cushions have an exceptionally soft surface because of their wrapped, layered construction. This exceptional softness requires more support at the front edge of the cushion. The horizontal middle segments 51 in the FIG. 7 form provide such support.

While several embodiments described herein are at present considered to be preferred, it is understood that various modifications and improvements may be made therein, and it is intended to cover in the appended claims all such modification and improvements as fall within the true spirit and scope of the invention.

I claim:

1. In a recliner chair including a cushion base assembly mounted on a pedestal and an ottoman moveable between a retracted position and an extended position, the improvement comprising:

(a) a seat frame including a back rail and a front rail;
(b) said front rail having an upper surface;
(c) spring means mounted between said front and back rails for providing resilient support to a cushion;
(d) jaw means mounted on said upper surface and extending forwardly of said front rail;
(e) said jaw means including a lower jaw and an upper jaw;
(f) said upper jaw and said lower jaw being resiliently joined over said front rail surface;
(g) upholstery means drawn tightly over said spring means and said jaw means;
(h) said upholstery means extending under said lower jaw in engagement therewith;
(i) a recess defined under said lower jaw and in front of said front rail whereby said ottoman can retract into said recess and nest therein with its upper surface substantially flush with a front surface defined by the upholstery fabric drawn over and extending between said upper and lower jaws.

2. The improvement in a recliner chair of claim 1 further characterized in that:

(a) said lower jaw is fastened to said front rail surface;
(b) said upper jaw is being free to resiliently move toward and away from said lower jaw when a load is applied and removed from the cushion base assembly.

3. The improvement in a recliner chair of claim 2 further characterized in that:

(a) said lower jaw is fastened to said rail surface in such a position that at least one and one half inches ($1\frac{1}{2}''$) of the lower jaw rests on said surface.

4. The improvement in a recliner chair of claim 1 further characterized in that:

(a) said jaw means includes a plurality of jaw members mounted on said upper surface of said front rail;

(b) each of said jaw members including a lower jaw element lying substantially flush on said upper surface of said front rail and an upper jaw element extending upwardly at an angle of between 30° and 45° to said lower jaw element, each of said jaw elements terminating in attachment feet;

(c) upper and lower border wire members rigidly connected to the attachment feet of corresponding upper and lower jaw elements in said jaw members to interconnect each of said jaw members.

5. The improvement in a recliner chair of claim 4 further characterized in that:

(a) said jaw members and border wire members are fabricated of relatively rigid wire having a noise reducing coating thereon.

* * * * *